US009149134B2

(12) United States Patent
Diwan

(10) Patent No.: US 9,149,134 B2
(45) Date of Patent: Oct. 6, 2015

(54) WALL MOUNTABLE HOCKEY EQUIPMENT RACK

(71) Applicant: Nazir Diwan, Pointe Claire (CA)

(72) Inventor: Nazir Diwan, Pointe Claire (CA)

( * ) Notice: Subject to any disclaimer, the term of this patent is extended or adjusted under 35 U.S.C. 154(b) by 91 days.

(21) Appl. No.: 13/792,348

(22) Filed: Mar. 11, 2013

(65) Prior Publication Data

US 2013/0240698 A1 Sep. 19, 2013

(51) Int. Cl.
*A47B 81/00* (2006.01)
*A47F 7/00* (2006.01)
*A63B 71/00* (2006.01)

(52) U.S. Cl.
CPC ..... *A47F 7/0021* (2013.01); *A47B 81/005* (2013.01); *A63B 71/0036* (2013.01)

(58) Field of Classification Search
CPC ..... A47F 7/0028; A47F 7/0021; A47B 81/00; A47B 81/005; A63B 71/0045; A63B 71/0036
USPC ..... 211/85.7, 70.6, 70.8, 87.01, 63, 62, 64, 211/60.1, 70.5, 70.2; 206/315.1, 315.2, 206/564; 248/231.91, 205.1, 534, 535, 539, 248/311.2
See application file for complete search history.

(56) References Cited

U.S. PATENT DOCUMENTS

| | | | | | |
|---|---|---|---|---|---|
| 1,719,360 | A | * | 7/1929 | Deike | 211/68 |
| 2,667,274 | A | * | 1/1954 | Diebold | 211/64 |
| 2,767,854 | A | * | 10/1956 | Barrett | 211/85.7 |
| 3,288,304 | A | * | 11/1966 | Graves | 211/64 |
| 4,033,460 | A | * | 7/1977 | Alexandre | 211/70.5 |
| 4,286,717 | A | | 9/1981 | Liesinger | |
| 5,143,227 | A | * | 9/1992 | Schubert | 211/64 |
| 5,358,127 | A | * | 10/1994 | Ennis | 211/60.1 |
| 5,620,091 | A | * | 4/1997 | Larson | 206/315.6 |
| 5,626,244 | A | * | 5/1997 | Mesna et al. | 211/60.1 |
| 5,829,604 | A | * | 11/1998 | Brophy | 211/70.2 |
| 5,906,304 | A | * | 5/1999 | Baldacchino | 224/406 |
| 6,120,224 | A | * | 9/2000 | Powell | 410/36 |
| 6,510,953 | B2 | * | 1/2003 | Daniels | 211/60.1 |
| 6,758,350 | B2 | * | 7/2004 | Lin | 211/70.6 |
| D579,252 | S | | 10/2008 | Savoie | |
| 7,441,669 | B1 | | 10/2008 | Dalbey | |
| 7,938,278 | B2 | * | 5/2011 | Dientsmann et al. | 211/70.2 |
| 8,807,501 | B2 | * | 8/2014 | Chung et al. | 248/231.91 |
| 2001/0003331 | A1 | * | 6/2001 | Heneveld | 211/70.6 |
| 2005/0121403 | A1 | | 6/2005 | Stubbs et al. | |
| 2006/0011566 | A1 | * | 1/2006 | Guy | 211/60.1 |
| 2008/0169210 | A1 | * | 7/2008 | Heidenreich | 206/315.2 |

(Continued)

*Primary Examiner* — Joshua Rodden
*Assistant Examiner* — Hiwot Tefera
(74) *Attorney, Agent, or Firm* — Daniel Boudwin; Global Intellectual Property Agency LLC

(57) ABSTRACT

A wall mountable hockey equipment rack is provided having a unitary, molded structure having an open channel and opposing upper support portions for supporting at least one inverted hockey stick therein. The upper support portions include at least one flared surface for supporting the upper curved edge of a hockey stick blade. Along the lower, lateral sides of the device is disposed a pair of cup-like holding members for receiving hockey pucks, equipment tape, and other equipment therein. Along the forward portion of the cup-like holding members is an upstanding equipment hook for supporting suspended items therefrom, such as hockey garments, tied-together ice skates, and other equipment that can be suspended from a hook-like structure. The open channel includes a back wall member having a plurality of fastener apertures therethrough for mounting the equipment rack against a planar wall surface during deployment.

10 Claims, 5 Drawing Sheets

(56) References Cited

U.S. PATENT DOCUMENTS

2010/0147785 A1* 6/2010 Yamamoto et al. ..... 211/85.7
2013/0105341 A1* 5/2013 Whitworth ..... 206/315.6
2013/0256168 A1* 10/2013 Poillot et al. ..... 206/372
2013/0320180 A1* 12/2013 Castellanos ..... 248/534
2014/0001328 A1* 1/2014 Chung et al. ..... 248/231.91

* cited by examiner

WALL MOUNTABLE HOCKEY EQUIPMENT RACK

CROSS REFERENCE TO RELATED APPLICATION

This application claims the benefit of U.K. Provisional Application No. 1204471.5 filed on Mar. 14, 2012, entitled "Wall Mountable Hockey Equipment Rack." The above identified patent application is herein incorporated by reference in its entirety to provide continuity of disclosure.

BACKGROUND OF THE INVENTION

1. Field of the Invention

The present invention relates generally to sport equipment storage racks and, more particularly to a wall mountable sport equipment rack usable for conveniently organizing and storing a plurality of hockey related spots equipment such as, for examples, hockey sticks, hockey pucks, ice skates, hockey related sport garments, and the like.

Sports equipment storage racks for hockey sticks and other types of equipment related to the hockey sport are known in the art and are useful for storing, organizing, and/or displaying hockey related sport equipment.

2. Description of the Prior Art

A first common type or hockey equipment rack of the prior art is generally represented by a wall mountable rack structure having a rear portion that is usually fixed to a vertically oriented support member, such as a wall or column. The rack structure is generally provided with shelves means and/or a plurality of support means that allows a user to support or otherwise releasably mount thereon portions of hockey related sport equipment such as hockey sticks, hockey pucks, hockey skates, hockey related sport garments and the like.

Another type of hockey equipment rack of the prior art is generally represented by a bucket-like member standing upright on a floor, or by a vertically oriented sleeve-like member fixed to a wall portion, and which allows a user to store one or more hockey sticks by simply inserting the shaft of an inverted hockey stick through the upper open end of the member.

Typical examples of the prior art are U.S. Pat. No. 7,441,669 to Dalbey, U.S. Design Pat. No. D579252 to Savoie, U.S. Patent Application Publication No. 2005/0121403 to Stubbs, and U.S. Pat. No. 4,286,717 to Liesinger. The Dalbey device describes a wall-mounted hockey stick rack with a plurality of aligned stick supports and an enlarged structure. The Savoie device provides a design for a structure having aligned apertures and insert locations for aligned hockey sticks along a wall surface. The Stubbs disclosure provides a wall mounted structure having an open interior for insertion of sticks therein, wherein the sticks are supported in a tilting fashion in one general location. Finally, the Liesinger device comprises a structure having a plurality of tubular object hanger supports aligned along a holder plate.

While these prior art hockey equipment racks generally offer a rack for storing and organizing hockey sticks, hockey skates, hockey pucks, and/or other hockey sport-related equipment, they also entail one or more of the following disadvantages: the rack-style structures having a rear portion attachable to a wall usually occupy a substantial amount of wall surface, while the bucket type rack does not necessarily store hockey sticks in a secure and organized way. Some of the prior art hockey equipment racks generally represent relatively complex structures that are not necessarily simple and economical to manufacture and sell on the market.

Against this background. there exists a need for a new and improved hockey equipment rack that avoids the aforementioned disadvantages. It is submitted that the present invention provides a substantially divergent support structure for hockey equipment, wherein the design elements of the present invention differ substantially from that of the prior art, and consequently it is clear that there is a need in the art for an improvement to existing hockey equipment support rack devices. In this regard the instant invention substantially fulfills these needs.

SUMMARY OF THE INVENTION

In view of the foregoing disadvantages inherent in the known types of hockey equipment racks now present in the prior art, the present invention provides a new rack support device, wherein the same can be utilized for providing convenience for the user when storing and supporting hockey sticks, equipment, and garments thereon.

It is a general object or the present invention to provide a new and improved storage rack for hockey related sport equipment. According to a preferred embodiment of the present invention, the hockey equipment rack is generally represented by a relatively compact, single piece structure that is preferably made of a polymeric material, or equivalent, using a conventional injection molding process to create a unitary support structure that is mountable to a wall and capable of supporting the weight of hockey equipment therefrom.

The hockey equipment rack generally includes a vertical back wall member defining a substantially planar rear surface attachable preferably at shoulder level to a substantially vertical and planar support structure such as a wall surface, or the like, using conventional fasteners such as screws, nails, adhesive, or the like.

Another object is to provide a unitary structure having a pair of oppositely disposed and substantially parallel main sidewall members being spaced apart from one another and extending outward from a wall-mountable back wall member, whereby the upper and lower portion of the main sidewall members are formed into specific shapes for supporting hockey inverted hockey sticks, hockey equipment, and hockey garments thereon.

Thus, the pair of main side wall members and back wall member cooperatively form a vertically oriented, channel-like member adapted for freely engaging a portion of at least one elongated shaft member of an inverted hockey stick inserted sidewardly therein, wherein the hockey shaft is vertical and the hockey blade is facing laterally outward and in parallel to the back wall member.

A pair of side wall upper end portions projects further substantially upwardly from the distal upper end of the main side wall members. Each side wall upper end portions cooperatively form at least one, but preferably more than one pair of oppositely disposed hockey blade abutment means for supporting the blade of a hockey stick thereon.

The plurality of hockey blade abutment means, in cooperative relation with the vertically-oriented, channel-like configuration defined by the back wall member and main side wall members, are configured and sized for freely receiving and holding therebetween a plurality, but preferably at least three inverted hockey sticks in a side-by-side and stacked fashion. Furthermore, the pairs of oppositely disposed hockey blade abutment means advantageously allow for the storage of left or right-handed hockey sticks, or a combination of left and right-handed hockey sticks therein.

Each hockey blade abutment means is shaped and sized for abuttingly engaging an inner curved edge portion of a conventional hockey stick at the transition between the stick shaft and the stick blade, when the latter is inverted with its blade end oriented laterally outward from center relative to the hockey equipment rack, and its elongated shaft member engaged between the side wall members of the rack.

The hockey equipment rack further includes a plurality, but preferably two substantially cup-like holding members disposed along opposite lateral side portions of the side wall members for freely receiving and holding therein a lower half portion of a hockey puck, hockey tape, or other equipment.

The hockey equipment rack further comprises a plurality, and preferably two, equipment hook means. Each hook means extends substantially upwardly from a front portion of the cup-like holding members for allowing a user to hook hanging equipment therefrom. Examples include a pair of tied together ice skates by their laces, the neck of a jersey or coat, a pair of tied together hockey gloves, the strap of a hockey helmet, the handle of a bag, and the like.

The relatively small hockey equipment rack of the present invention thus advantageously stores a plurality of hockey sticks, hockey pucks, ice skates, and/or other related or ancillary hockey related sport equipment therefrom along a wall and in a manner that does not consume an unnecessary portion of wall space for its purpose.

The main advantages of the hockey equipment rack of the present invention over prior art hockey equipment racks are as follows. The present wall mountable hockey equipment rack provides a unique and novel way of securely storing and organizing in a convenient fashion a plurality of hockey related sport equipment. The device further provides a wall mountable hockey equipment rack having a relatively small format or footprint as compared to prior art equipment racks, consequently occupying relatively less wall surface space when deployed. The device also comprises a relatively simple and economical device that can be readily manufactured, sold on the market, and thereafter deployed in hockey locker rooms for equipment storage and support.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
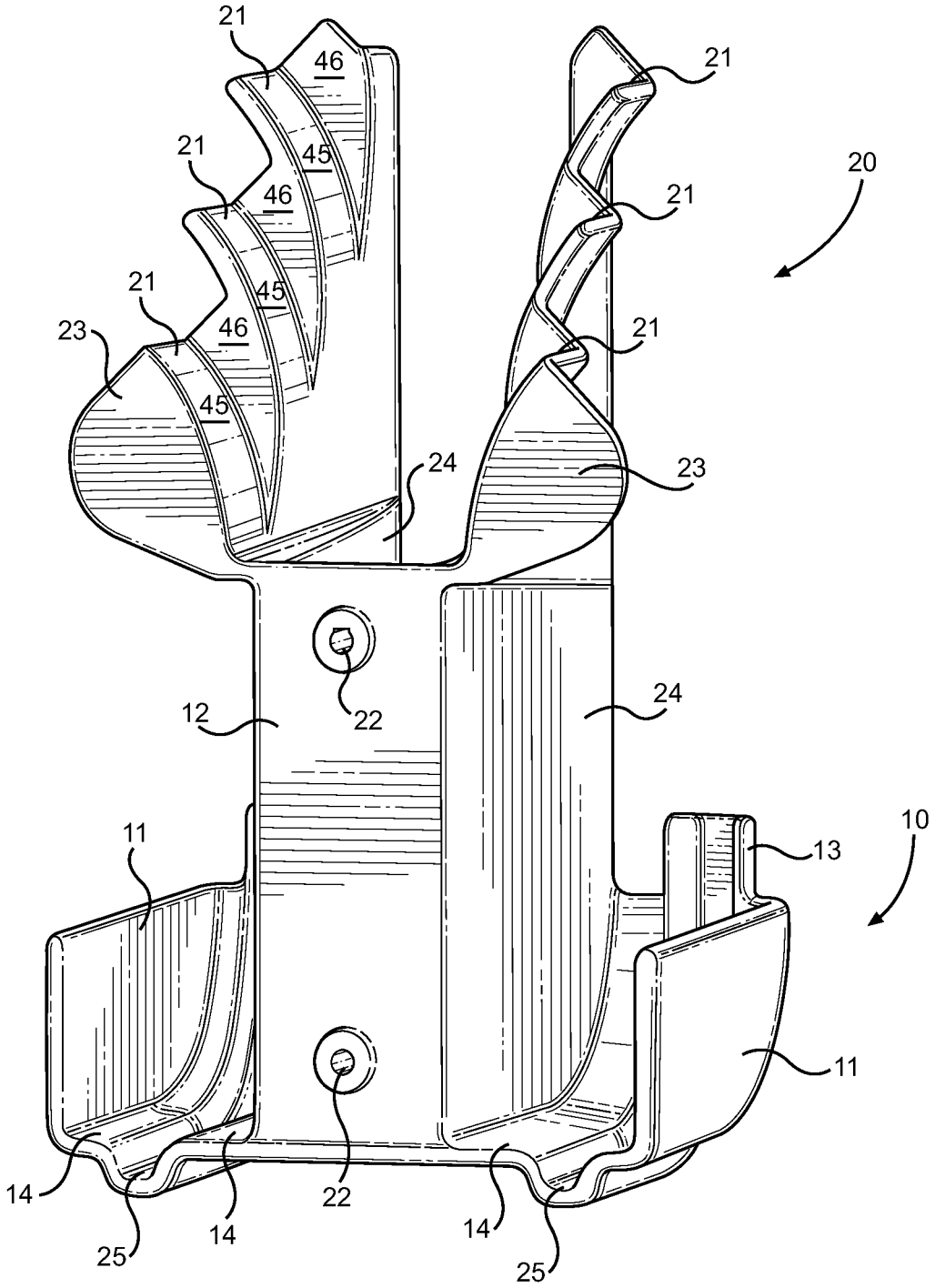
FIG. 1 shows a rear perspective view, illustrating the present hockey equipment rack according to a preferred embodiment of the present invention.
Figure 2:
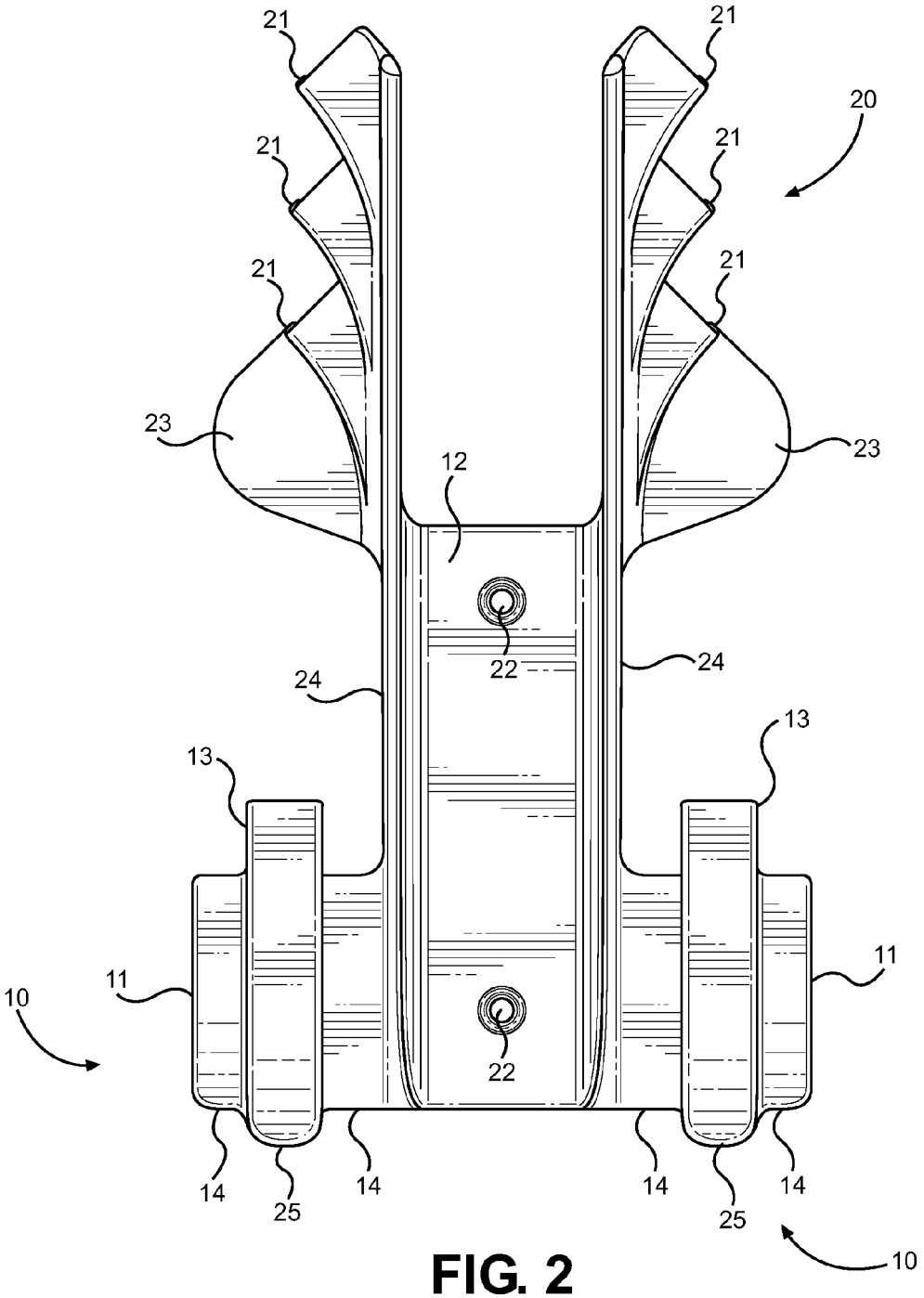
FIG. 2 shows a front view of the hockey equipment rack of the present invention.
Figure 3:
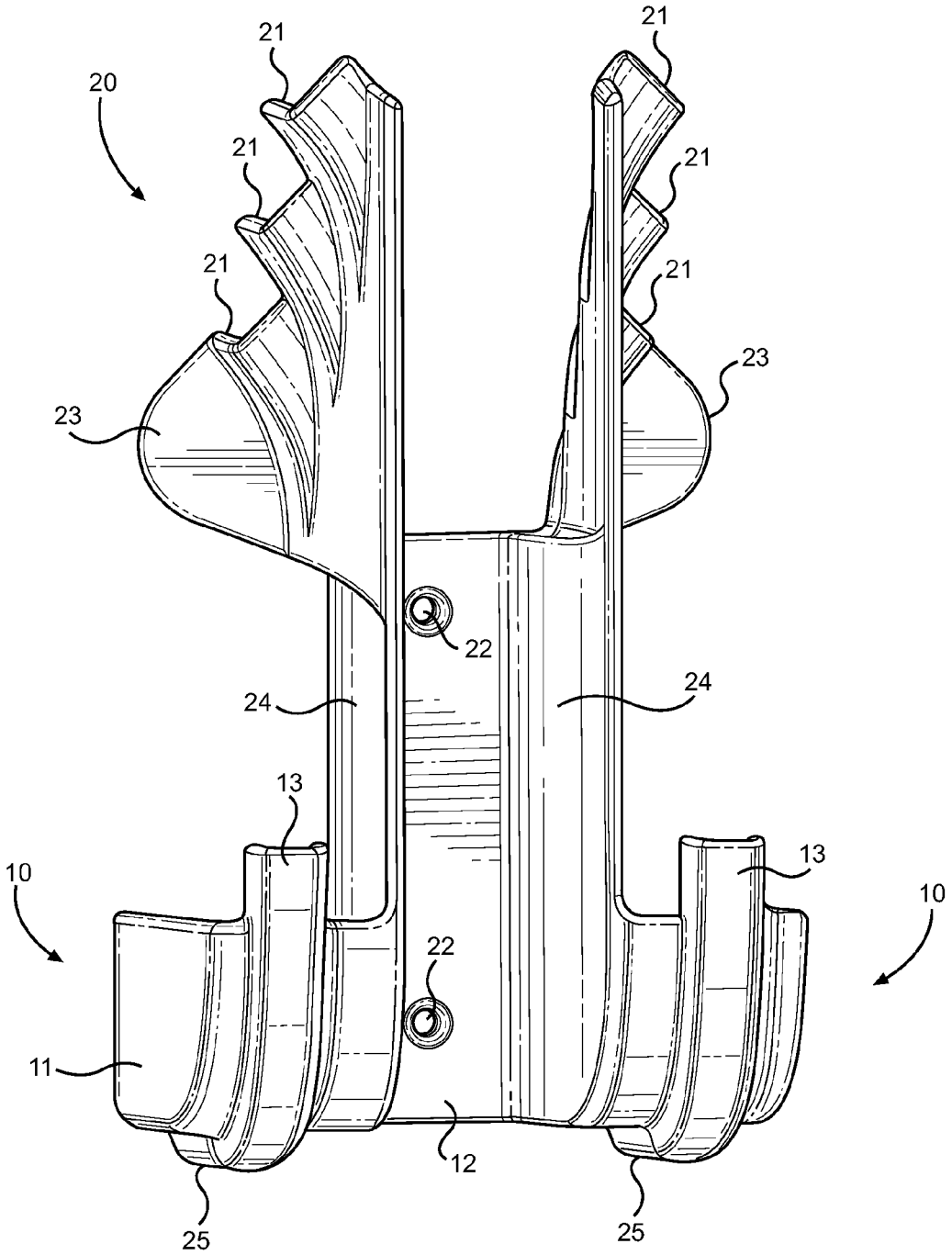
FIG. 3 shows a frontal perspective view of the present invention.

Reference is made herein to the attached drawings. Like reference numerals are used throughout the drawings to depict like or similar elements of the wall-mounted hockey equipment support rack. For the purposes of presenting a brief and clear description of the present invention, the preferred embodiment will be discussed as used for providing a compact, rugged, and unitary support rack for hockey sticks, skates, pucks, equipment, and garments on a wall surface. The figures are intended for representative purposes only and should not be considered to be limiting in any respect.

FIGS. 1 through 6 inclusively illustrate various aspect of a preferred embodiment of a wall mountable hockey equipment rack according to the present invention. The hockey equipment rack is generally represented by a unitary structure that is preferably made of a polymeric material or equivalent, formed using a conventional injection molding process.

The hockey equipment rack generally includes a substantially rectangular shaped and vertically oriented back wall member 12 defining a substantially planar back wall surface for abuttingly contacting a vertical planar surface such as a wall surface 40, and a substantially planar front wall surface. When applied to a wall 40, the back wall member 12 is flush thereagainst and fasteners 35 are driven through corresponding fastener apertures 22 in the back wall 12 to secure the assembly and any equipment suspended therefrom.

Along the back wall member 12 is disposed a plurality, but preferably two, vertically spaced apart fastener apertures 22 for fixedly attaching the hockey equipment rack to preferably a wall surface 40, or the like, using preferably conventional fasteners 35 such as, for example, screws, nails, or wall anchors.

Extending from the back wall member 12 is a first and second main side wall member 24 extending away from the back wall member 12 and separated by the width thereof to form an open channel 30. The pair main side wall members 24 are oppositely disposed and substantially parallel to one another and project perpendicularly and frontwardly from side of the back wall member 12, wherein each wall member 24 extends vertically and substantially the whole longitudinal length thereof. The width of the back wall member 12 is substantially equivalent to the cross section of a hockey stick shaft 72, whereby the shaft 72 of a hockey stick 70 can easily be positioned within the open interior 30 defined between the main side wall members 24 and the back wall member 12.

Between the main side wall members 24 and along the forward portion of the device is an opening to the channel 30 to allow the hockey stick shafts 72 to be slotted therethrough and into the interior of the assembly. In this way, the vertically oriented channel 30 is adapted for freely and slideably engaging a portion of at least one elongated shaft member 72 of a vertically oriented hockey stick 70 inserted therein with its hockey blade 73 directed to one side of the device.

Above each side wall member 24 is an upper portion 20 projecting substantially upwardly and outwardly from each main side wall member 24 distal upper end. Each side wall upper end portion 20 cooperatively form at least one, but preferably more than one, pair of oppositely disposed hockey blade abutment means 21. Each blade abutment means 21 is a flared and curving surface that substantially follows the contour of a hockey stick 70 at the location 71 on a hockey stick where the shaft transitions into the hockey stick blade. This contour 71 exists at the transition between the shaft 72 and blade 73 along the upper edge of the hockey blade, which is rests against the blade abutment means 21 while the hockey shaft 72 is suspended within the open interior channel 30 between the side wall members 24.

The plurality of oppositely-disposed hockey blade abutment means 21 are distributed in a parallel, side-by-side relationship extending between the back wall member 12 and the frontmost portion of the hockey equipment rack. The plurality of hockey blade abutment means 21, in cooperative relation with the vertically oriented channel 30 defined by the back wall member 12 and main side wall members 24, are configured and sized for freely receiving and holding therebetween a plurality, but preferably three (3) inverted hockey sticks 70 in a side-by-side, stacked fashion. Furthermore, the pairs of oppositely disposed hockey blade abutment means 21 advantageously allows for the storage of left or right-handed hockey slicks, or a combination of left and right-handed hockey sticks.

It is to be understood that in alternate embodiments of a hockey equipment rack, according to the present invention, may include less than three, or more than three pairs of oppositely disposed hockey blade abutment means 21. For example, an alternate embodiment of the hockey equipment rack may include only one pair of oppositely disposed hockey blade abutment means 21. In yet other alternate embodiments, a hockey equipment rack may include six (6) pairs or oppositely disposed hockey blade abutment means 21.

Figure 6:
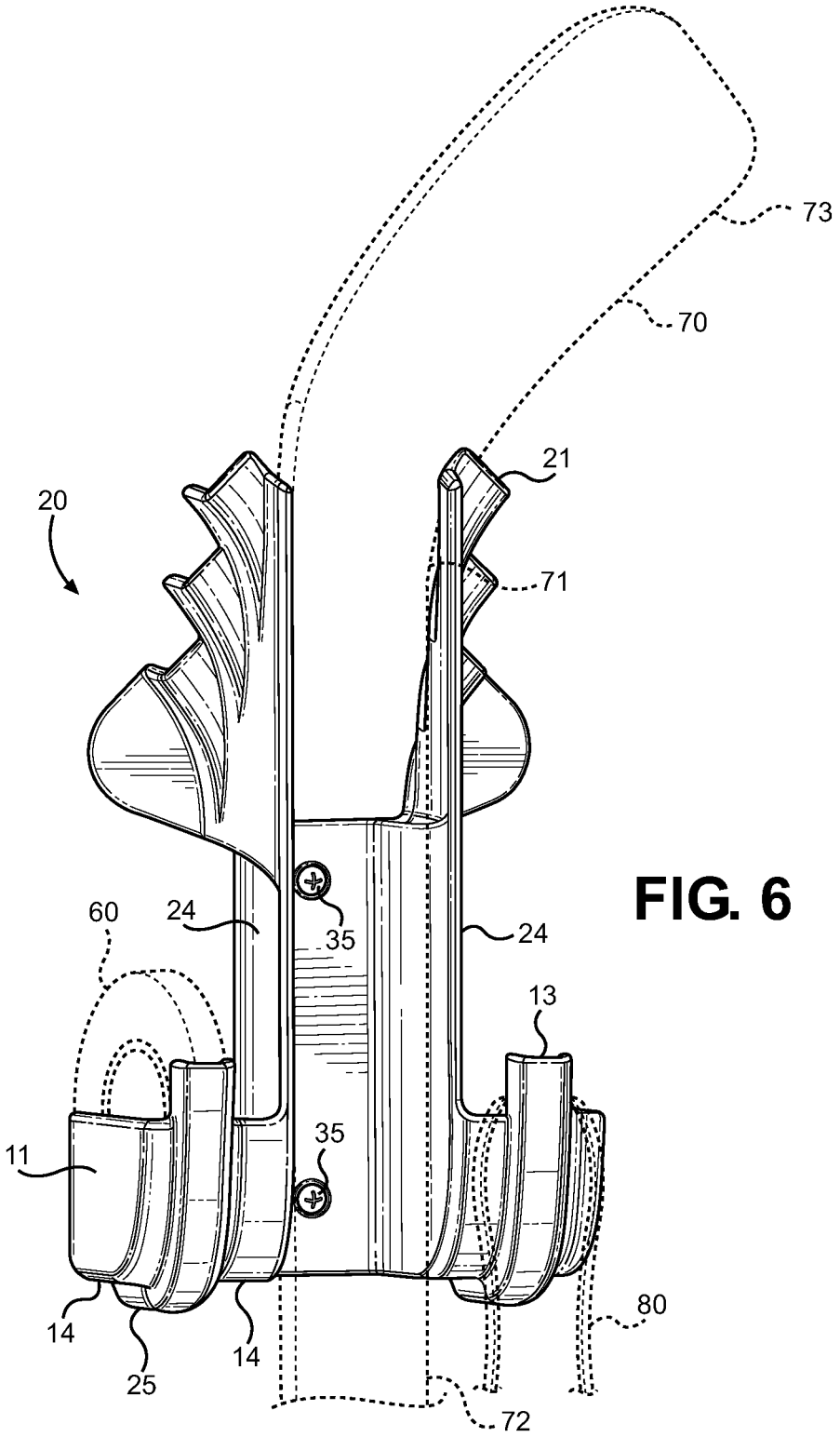
FIG. 6 shows an environmental, frontal perspective view illustrating the hockey equipment rack shown holding one hockey stick, a roll of hockey tape, a pair of tied together ice skates.

Each hockey blade abutment means 21 is shaped and sized for abuttingly engaging an inner curved edge portion 71 of a conventional hockey stick 70, when the latter is inverted with its blade end 73 oriented distally laterally relative to the hockey equipment rack, and its elongated shaft member 72 engaged between the side wall members 24, as best illustrated in FIG. 6.

Preferably, each hockey blade abutment means 21 is represented by a relatively short and outwardly curving support surface 45 continuing from the main side wall member 24 surfaces. The outwardly curved support surface 45 substantially conforms to the inner curved edge portion 71 of a conventional hockey stick 70, and preferably has a surface width that substantially corresponds to the thickness of the elongated shaft member 72 or the stick 70. Each hockey blade abutment means 21 further preferably includes an upstanding wall member 46 extending substantially perpendicularly upwardly along a side edge thereof that is closest to the frontmost portion of the hockey equipment rack.

Figure 4:
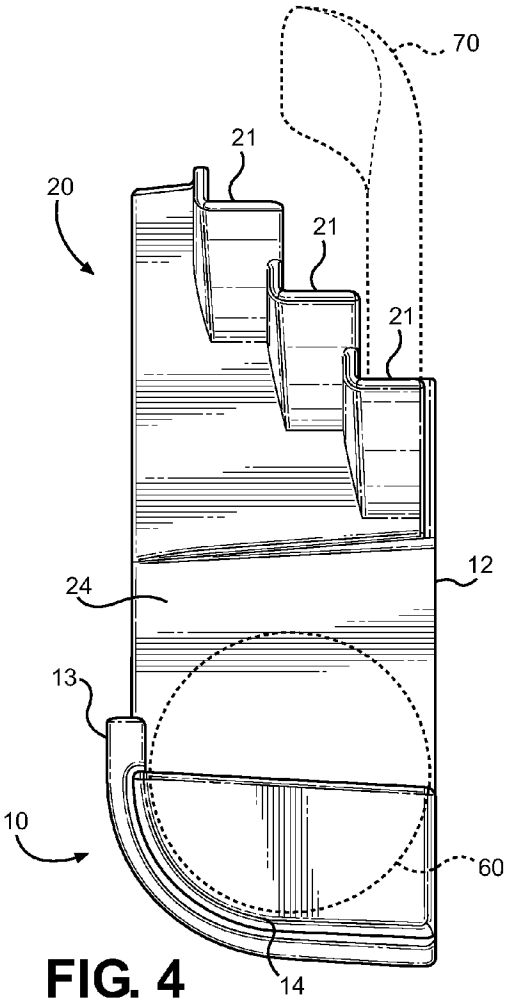
FIG. 4 shows a lateral side view of the present invention.

Furthermore, the pairs of oppositely disposed hockey blade abutment means 21 generally define a rearmost pair, an intermediate pair and a frontmost pair of opposed abutment means. Moving from the back wall member 12 toward the frontmost portion of the device, the height of the abutment means decreases in a stepped configuration. The rearmost pair of abutment means 21 being relatively lower than the frontmost pair, with the intermediate pair being vertically equidistantly positioned therebetween. Thus, the pairs of oppositely disposed hockey blade abutment means 21 generally form a substantially stair like configuration ascending from the rearmost pair to the frontmost pair when the hockey equipment rack is observed in a side view, as illustrated in FIG. 4.

Thus, the curved portion side wall members 24, the rear-to-front climbing stair like configuration of the hockey blade abutment means 21, and the channel 30 configuration defined by the back wall member 12 and main side wall members 24 cooperatively provide retaining means to prevent one or more hockey sticks 70 engaged in the hockey equipment rack from falling off the latter, for example, when inadvertently hit by players passing thereby, as is frequently the case in generally crowded players locker room.

The hockey equipment rack may further preferably include a pair of stabilizing flange members 23 for enhancing the lateral stability of the hockey equipment rack when mounted on a wall surface 40. The pair of stabilizing flange members 23 is oppositely laterally extending from rear edge portions of the rearmost pair of hockey blade abutment means 21. The rear surface of the pair of stabilizing flange members 23 are in register with the generally planar plane represented by the back wall rear surface 40.

In an alternate embodiment of a hockey equipment rack according the present invention, all the pairs of oppositely disposed hockey blade abutment means 21 are aligned on a same horizontal level.

In yet another embodiment of a hockey equipment rack according the present invention (not shown), the rearmost pair of oppositely disposed hockey blade abutment means 21 is relatively vertically higher than the frontmost pair, with the intermediate pair vertically equidistantly positioned therebetween in a descending rear to front stair like configuration.

The hockey equipment rack may further preferably include n plurality, but preferably one pair of substantially cup-like members 10 extending distally laterally along outer lateral portions of the main side wall members 24. Preferably, each cup-like member 10 generally defines an upwardly oriented open cavity having an inner volume that is configured and sized for freely receiving therein the volume of one diametrical half portion of a hockey puck or roll of hockey tape 60 inserted sidewardly and substantially parallelly relative to the adjacent main side wall member 24, as illustrated in FIG. 6.

Figure 5:
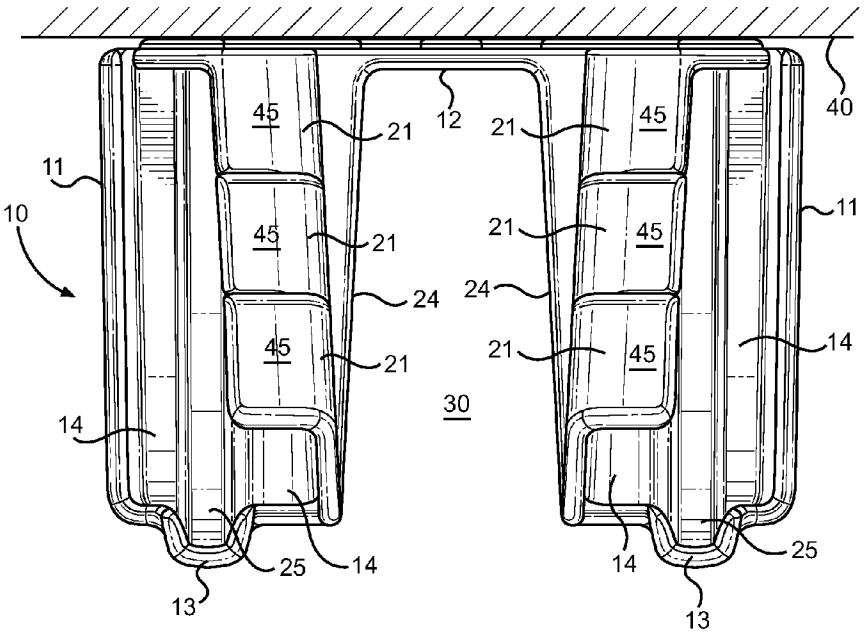
FIG. 5 shows an overhead view of the present invention attached to a wall surface.

As best illustrated in FIGS. 1 and 5. the cavity of each cup-like member 10 is preferably rear open-ended such that, with the hockey equipment rack mounted on a wall surface 40, the wall surface 40 serves as a rear end wall for retaining a rear portion of a hockey puck or roll of tape 60 inserted therein. The advantages of this particular configuration include a hockey equipment rack that is both aesthetic and relatively easy and economical to manufacture using a conventional injection molding process.

In another embodiment of a hockey equipment rack, according to the present invention, at least two pairs of substantially cup like holding members 10 extend oppositely laterally along outer lateral side portions of the main side wall members 24 to provide support for hockey pucks, rolls of tape, and other equipment therein.

The hockey equipment rack further includes a plurality, but preferably one pair of hook means 13 for allowing to hook thereon, for example, a pair of tied together ice skates, the neck of a sport jersey or towel, a pair of tied together hockey gloves by their laces 80, the strap of a hockey helmet, the handle of a bag, and the like, as illustrated in FIG. 6. For example, each hook means 13 may extends substantially frontwardly and upwardly from a substantially centered front portion of the cup-like holding members 10.

In other embodiments of a hockey equipment rack, according to the present invention, at least two pairs of hook means 13 extends substantially frontwardly upwardly from spaced apart front portions of the cup-like holding members 10. As best illustrated in FIG. 6, the relatively small hockey equipment rack of the present invention may thus advantageously store a plurality of hockey sticks 70, rolls of hockey tape 60 or hockey pucks, a plurality of pairs of ice skates by their laces 80, a towel, and/or other hockey related sport equipment.

Along the cup-like members 10 is an elongated channel 25 disposed along the cup lower surface 14, which extends along the lower surface in parallel to the main side wall members 24. This channel can be utilized to secure rolls of tape, pucks, or other equipment therein. The cup-like members 10 establish an internal volume disposed between a wall surface 40, a main side wall member 24, an outer upstanding cup wall surface 11, and the curved cup lower surface 14, which angularly extends from the wall 40 to the upper edge of the cup-like member 10.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wall-mountable hockey equipment rack, comprising:

a vertically oriented back wall member, a first side wall member, and a second side wall member forming an open channel having an open front, an open bottom, and an open upper;

said first side wall member and said second side wall member having opposing upper portions extending outwardly from said first side wall member an said second side wall member;

said opposing upper portions comprising a plurality of outwardly curving support surfaces, wherein said plurality of outwardly curving support surfaces on said first side wall member and said second wall member project outwardly in opposing directions;

said plurality of outwardly curving support surfaces disposed in an offset step configuration on said upper portions of said first side wall member and said second side wall member;

said vertically oriented back wall having at least one fastener aperture therethrough for securing said back wall member to a wall surface.

2. The device of claim 1, wherein said plurality of outwardly curving support surfaces are adjacently disposed for bearing a hockey stick contour thereagainst;

an upstanding wall member extending substantially perpendicularly from said curving support surface between said adjacent curving support surfaces;

said adjacent curving support surfaces forming a stepped configuration.

3. The device of claim 1, further comprising:

a cup-like member extending laterally along outer portions of at least one main side wall member;

said cup-like member comprising an outer upstanding cup wall, a curved cup lower surface, an interior volume, an open upper and an open rear to be positioned against a wall surface.

4. The device of claim 3, wherein said cup-like member further comprises an elongated channel disposed along said curved cup lower surface.

5. The device of claim 3, wherein said cup-like member comprises an upper edge, said upper edge having at least one upstanding hook means for supporting hanging items therefrom.

6. The device of claim 1, further comprising:

a rear-most stabilizing flange member for abutting against a wall surface and enhancing lateral stability, said flange member extending laterally from a rear edge of a rearmost outwardly curving support surface.

7. The device of claim 1, wherein said hockey equipment rack is formed of a unitary molded structure.

8. The device of claim 1, wherein said plurality of the outwardly curving support structures comprise at least three outwardly curving support structures on said upper portions of said first side wall member and said second side wall member.

9. The device of claim 8, wherein said at least three outwardly curving support structures are parallel with said back wall member.

10. The device of claim 1, wherein said plurality of outwardly curving support surfaces comprise a lower curved surface and an adjacent side wall.

* * * * *